US012385200B2

(12) United States Patent
Ferkel

(10) Patent No.: US 12,385,200 B2
(45) Date of Patent: Aug. 12, 2025

(54) ANIMAL FECES COLLECTING ROBOT

(71) Applicant: Jason Ferkel, Greenwood, IN (US)

(72) Inventor: Jason Ferkel, Greenwood, IN (US)

( * ) Notice: Subject to any disclaimer, the term of this patent is extended or adjusted under 35 U.S.C. 154(b) by 794 days.

(21) Appl. No.: 17/718,186

(22) Filed: Apr. 11, 2022

(65) Prior Publication Data

US 2023/0323615 A1 Oct. 12, 2023

(51) Int. Cl.
*E01H 1/00* (2006.01)

(52) U.S. Cl.
CPC ..... *E01H 1/006* (2013.01)

(58) Field of Classification Search
CPC ..... E01H 1/006
(Continued)

(56) References Cited

U.S. PATENT DOCUMENTS 10,555,498 B2 * 2/2020 Womble ..... A01K 5/0114
11,933,005 B1 * 3/2024 Nichols ..... E01H 1/006
(Continued)

FOREIGN PATENT DOCUMENTS

CN 107926737 * 4/2018 ..... G05D 27/02

OTHER PUBLICATIONS

CN107926737 machine translation (Year: 2018).*

*Primary Examiner* — Jacob S. Scott
*Assistant Examiner* — Michael E Butler

(74) *Attorney, Agent, or Firm* — David E. Novak; Brannon Sowers & Cracraft PC

(57) ABSTRACT

The preset novel animal feces collection and storage system includes a stationary garage portion and a mobile robot portion. The stationary garage portion includes a garage housing, a door operationally connected to the garage housing, a door opener assembly connected to the garage housing and operationally connected to the door, a raised platform disposed within the garage housing, a ramp extending from the raised platform toward the door, an aperture formed through the raised platform, a bin disposed below the aperture, a charge port positioned within the garage housing, a power source operationally connected to the charge port, a first microprocessor positioned within the garage housing and operationally connected to the power source, a first transceiver operationally connected to the first microprocessor and to the power source, and a weight scale operationally connected to the bin, the power source, and the first microprocessor. The robot include a housing, spaced front and real axels operationally connected to the housing, spaced wheels operationally connected to each respective axel, a motor within the housing and operationally connected to the at least one respective axel, a battery disposed within the housing and operationally connected to the motor, a power jack extending through the housing and connected to the battery, a pan assembly operationally connected to the housing, a second microprocessor, a forward sensor assembly mounted to the housing and operationally connected to the second microprocessor, a guidance unit operationally connected to the second microprocessor and to at least one respective axel, a GPS transponder operationally connected to the robot housing, and to the second microprocessor, and a transceiver operationally connected to the second microprocessor. The microprocessor receives images from the forward sensor assembly and directs the guidance unit to steer the mobile robot to feces deposits. The second microprocessor sends signals to deploy the pan assembly to pick up feces deposits for transport back to the garage housing to be deposited into the bin.

6 Claims, 4 Drawing Sheets

(58) Field of Classification Search
USPC ..... 701/228
See application file for complete search history.

(56) References Cited

U.S. PATENT DOCUMENTS

2019/0271125 A1* 9/2019 Fornarotto ..... G05D 1/0246
2022/0066456 A1* 3/2022 Ebrahimi Afrouzi ..... G06F 3/04883

* cited by examiner

ANIMAL FECES COLLECTING ROBOT

TECHNICAL FIELD

The present novel technology relates generally to the robotics, and, more particularly, to an automated roving robot for locating, collecting, and retrieving animal feces for storage and disposal.

BACKGROUND

Urban and suburban dog owners know that their yards will inevitably become littered with animal droppings that will eventually have to be picked up and disposed of. This is generally considered one of the least attractive elements of pet ownership. While poop-scoops and the like have been developed to make the collection and disposal process less odious, the pet owner still has to endure personally collecting and bagging the dog feces. Thus, there is a need for a device performs the unpleasant task of dog poop collection for you. The present novel technology addresses this need.

DETAILED DESCRIPTION OF THE PREFERRED EMBODIMENT

Figure 1:
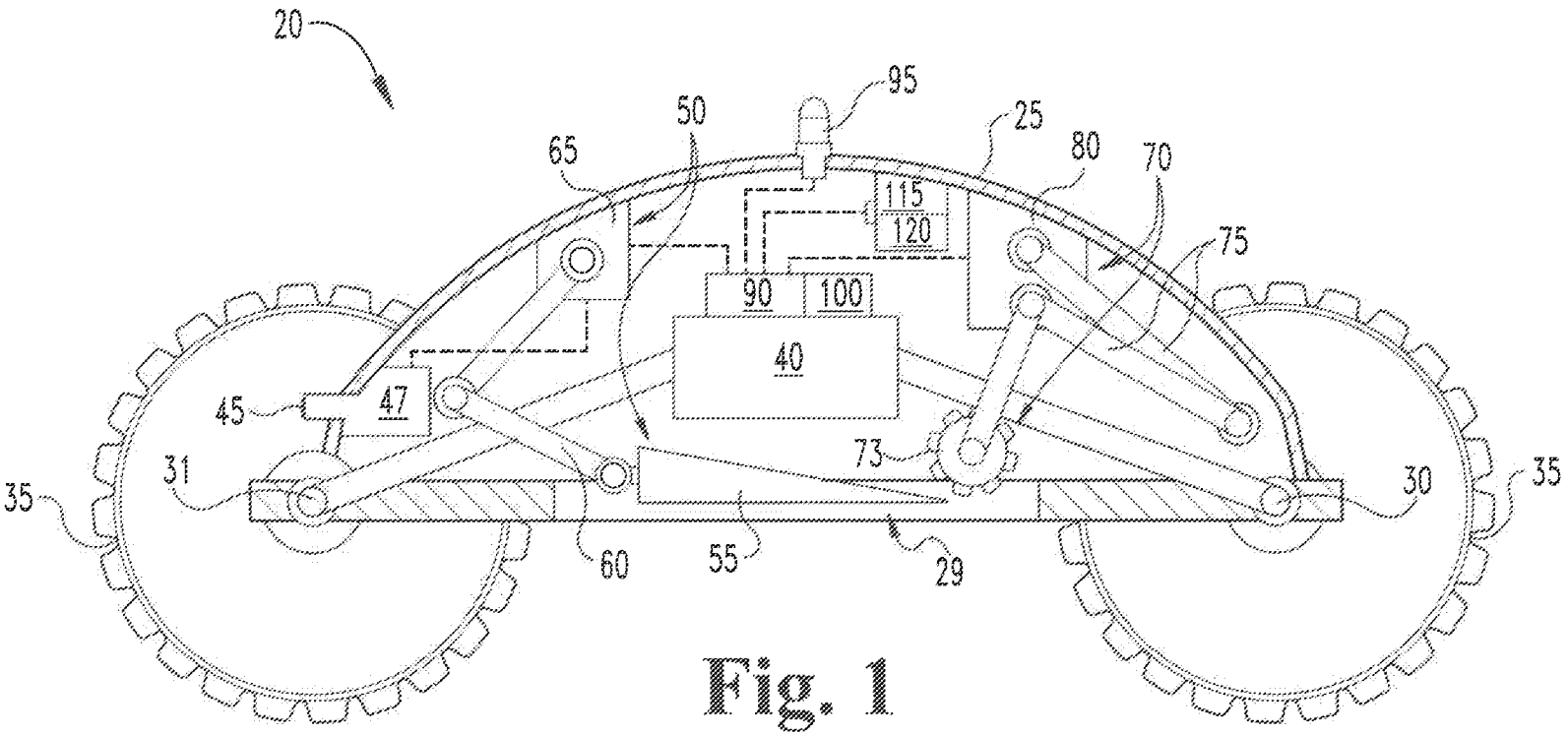
FIG. 1 is a side cutaway view of a first embodiment feces collection robot according to the present novel technology.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

Figure 2:
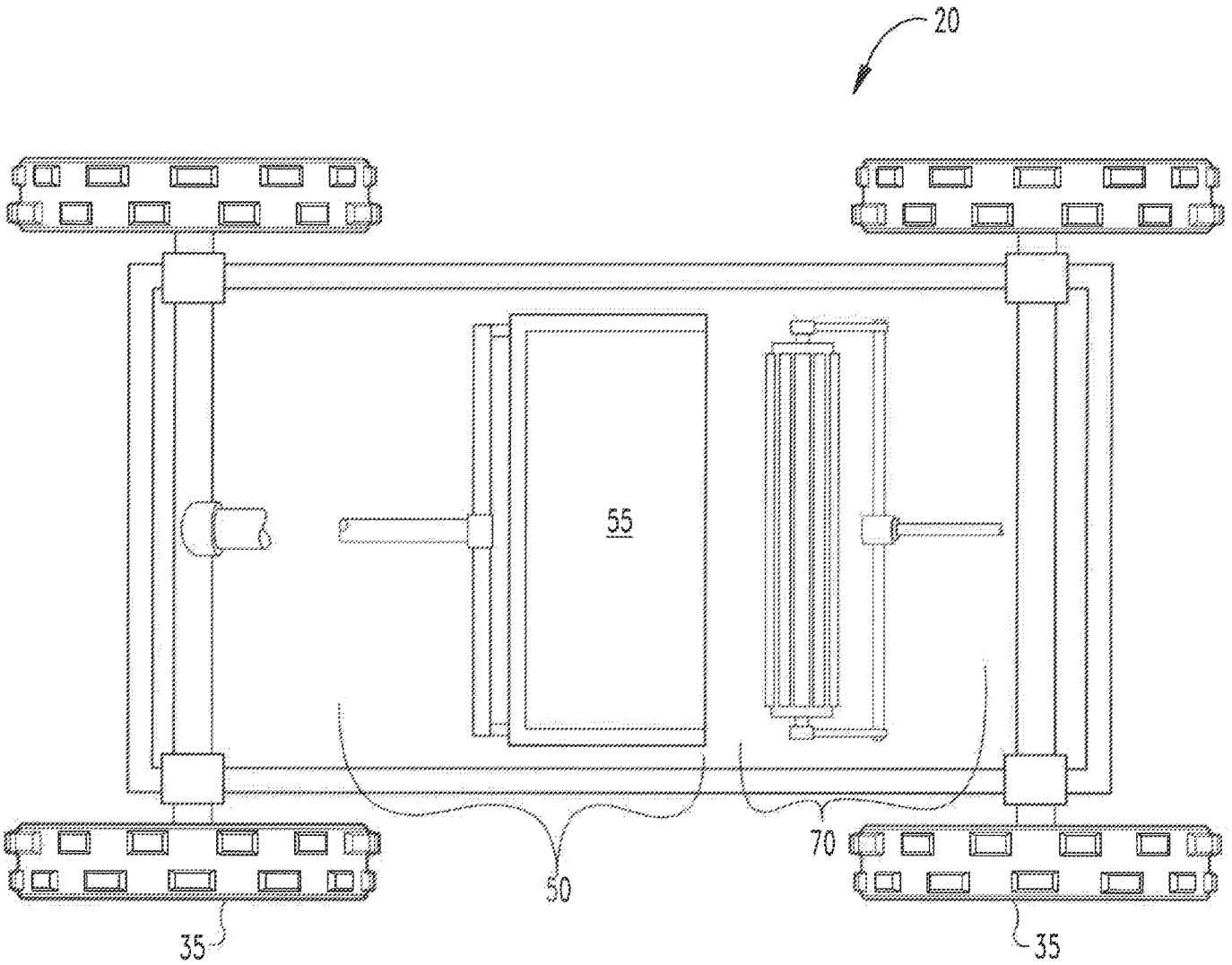
FIG. 2 is a top plan cutaway interior view of the embodiment of FIG. 1.
Figure 3:
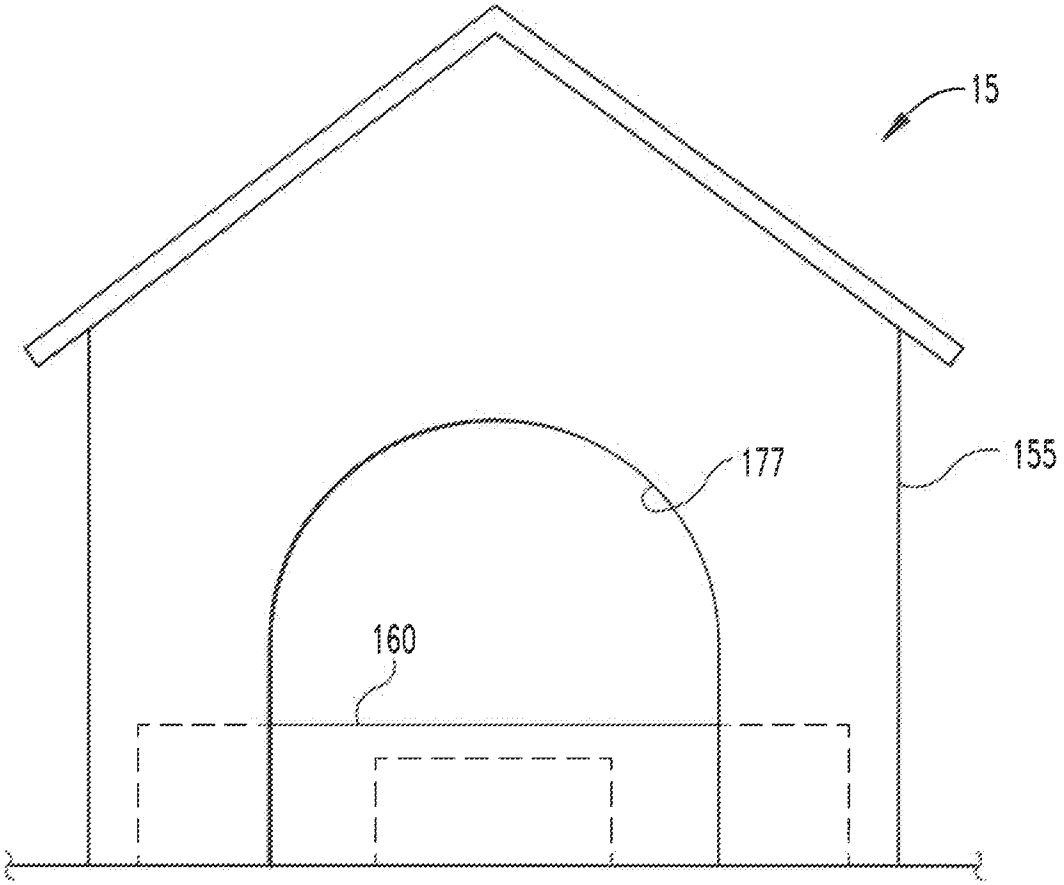
FIG. 3 is a first front elevation view of a garage housing for receiving and recharging the embodiment of FIG. 1.
Figure 4:
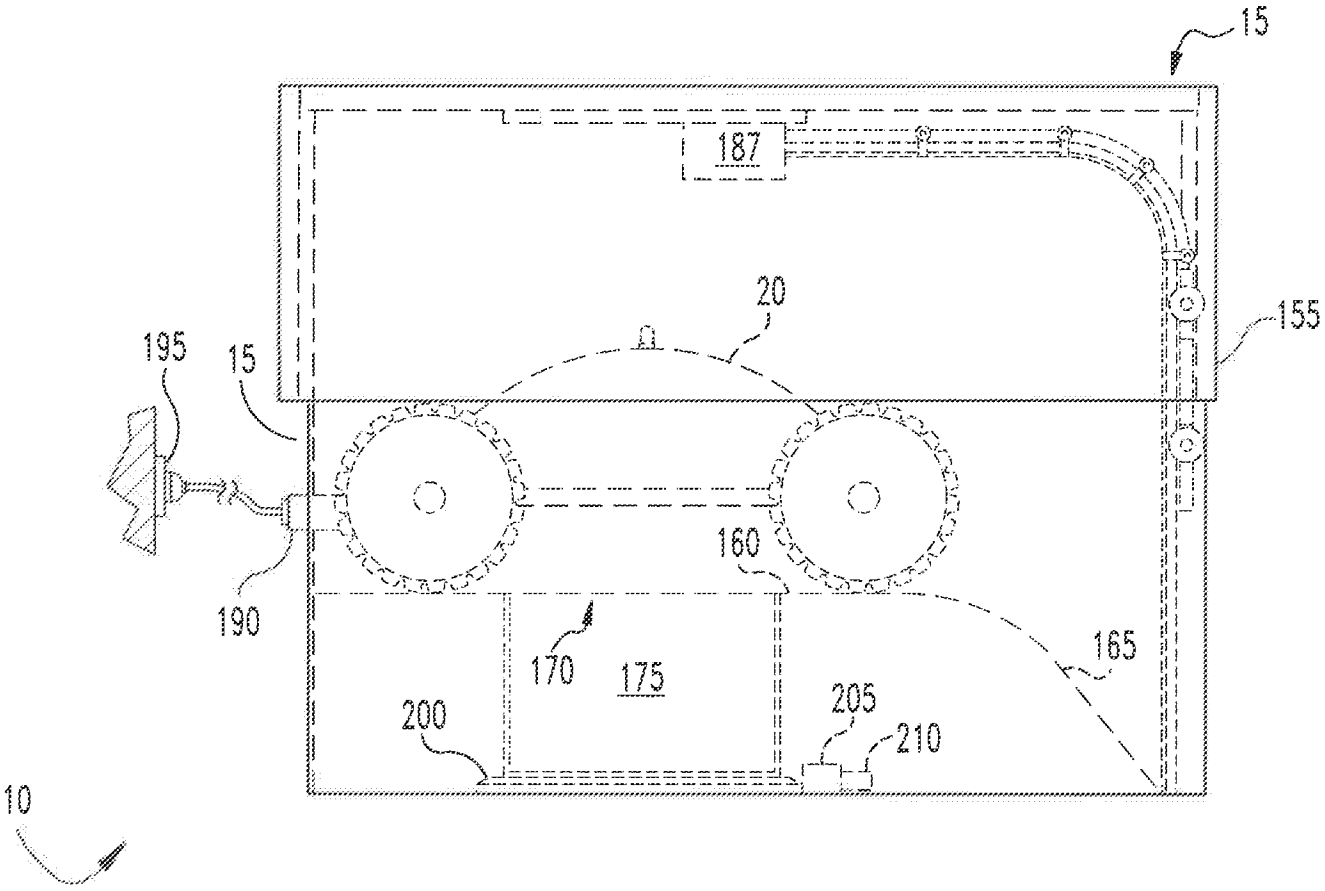
FIG. 4 is a top plan cutaway view of the embodiment of FIG. 3.

The novel technology shown in FIGS. 1-4 relates to a system or assembly 10 or retrieving, storing, and disposing of animal, typically dog, feces. The system 10 includes a stationary garage assembly portion 15 and a mobile or roving robot assembly portion 20. The robot portion 20 is housed and recharged in the garage portion 15 when not in active feces collection mode.

The robot portion 20 includes a generally elongated housing 25 defining an internal volume 27 and having a bottom opening 29. A front axle 30 and a spaced rear axle 31 are disposed in the internal volume 27 and are operationally connected to the housing 25. A plurality of wheels 35 are operationally connected to the axles 30, 31. An electric motor 40 is disposed within the housing 25 and operationally connected to at least one axel 30, 31. A power jack 45, such as a USB or like port, extends through the housing 25 and is operationally connected to a battery 47 disposed within the housing 25 and operationally connected to the motor 40.

A pan assembly 50 is also disposed in the interior volume 27. Pan assembly 50 includes a generally flat elongated pan member 55 and a first articulated armature 60 operationally connected to housing 25 and to pan member 55. The armature 60 may be operationally connected to motor 40 or to a separate servo 65 that is likewise connected in electric communication with battery 47.

A roller assembly 70 is likewise disposed in the interior volume 27. Roller assembly 70 includes a generally cylindrical roller 73 and a second articulated armature 75 operationally connected to the roller 73 and to the housing 25. The armature 75 may be operationally connected to motor 40 or to a separate servo 80 that is likewise connected in electric communication with battery 47.

A microprocessor 90 is also disposed in the interior volume 27 and operationally connected to the battery 47, the motor 40, and to the first and second servos 65, 80, if present. A sensor 95 is operationally connected to the housing 25 and connected in electric communication with the microprocessor 90. The sensor 95 may be a camera or any other convenient sensor 95 capable of detecting and differentiating animal feces. The camera 95 may be stationarily mounted to face in a direction defined by the camera 95 as 'forward', or may be swivel/gimbal/pivotably mounted via a motor mount 105 such that the electronic controller 90 may control the movement and directionality of the camera 95. A guidance system 100 may also be positioned within the interior volume 27 and operationally connected to the electronic controller 90, the motor 40, and/or an axel 30, 31. A GPS unit 115 and/or a transceiver 120 may likewise be connected to the housing 25 and operationally connected to the microprocessor 90. The transceiver 120 may allow communication between the microprocessor 90 and an external control device, such as a computer or cell phone.

Garage assembly 15 typically includes a garage housing 155, often shaped as a dog-house, and and a raised platform 160 positioned within the housing 155. A ramp 165 extends from the raised housing to the ground. The raised housing includes an aperture 170 formed therethrough, with a collection bin 175 positioned under the platform 160 and below the aperture 170. An entryway or doorway 177 is formed through the housing 160 and positioned to allow egress into the housing 160 and access to the ramp 165. An automatic garage door 180 may be positioned within the housing 160 to block the entryway 177. An automatic garage door opener assembly 185 may be operationally connected to the door 180, including a motor 187 and tracks 189.

A charge port 190 may be operationally connected to the platform 165 and/or to the housing 160 and operationally connected to a power source 195. A weight scale 200 is operationally connected to the waste bin 175 for measuring when the bin 175 is full and in need of emptying. A microprocessor 205 is operationally connected to a transceiver 210 and to the weight scale 200 and garage door motor 187 for alerting a user that the bin 175 is full and for receiving a signal from the robot 20 to open and/or to shut the door 180.

In operation, the rover assembly 20 is stored for charging and protection in the dog house garage 15 until needed. When desired, the rover assembly 20 is activated, such as by a signal from a control device received by the electronic controller 90 via the transceiver 120. The electronic controller 90 send a signal to the opener assembly 185 which opens the door 180. The rover assembly 20 energizes its motor 40 to move the rover down the ramp 160, disengaging the power jack 45 from the charging port 190. The rover 20 emerges from the housing 15 and proceeds to move over a predetermined landscape area, such as a front lawn, a back lawn, and/or the like, using the camera 95 to scan for feces deposit. Upon detection of a feces deposit, the rover extends the pan 55 and roller 70 to urge the feces deposit onto the pan 55. The pan is then retracted 55 to move the feces deposit into the rover body 27. This process may be repeated until all feces deposits have been moved into the rover 20. In some embodiments, the rover 20 is manually directed via control signals from received by the electronic controller 90.

Once the rover 20 has collected the feces deposits, the rover 20 reenters the housing 15 and empties the feces through the bottom aperture 29 and housing aperture 170 into the collection bin 175. The housing may weight the feces deposits using the scale 200. The weight data is received by microprocessor 205, which may send a signal via transceiver 200 when a predetermined mass of feces is present in the bin 175, signaling a user that it is time for the bin to be emptied.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. An automated animal feces collection and storage system comprising:

a stationary garage portion; and a mobile robot portion;

wherein the stationary garage portion further comprises:

a garage housing;

a door operationally connected to the garage housing;

a door opener assembly connected to the garage housing and operationally connected to the door;

a raised platform disposed within the garage housing;

a ramp extending from the raised platform toward the door;

an aperture formed through the raised platform;

a bin disposed below the aperture;

a charge port positioned within the garage housing;

a power source operationally connected to the charge port;

a first microprocessor positioned within the garage housing and operationally connected to the power source;

a first transceiver operationally connected to the first microprocessor and to the power source; and a weight scale operationally connected to the bin, the power source, and the first microprocessor;

wherein the mobile robot further comprises:

a robot housing;

spaced front and real axels operationally connected to the robot housing;

spaced wheels operationally connected to each respective axel;

a motor disposed within the robot housing and operationally connected to the at least one respective axel;

a battery disposed within the robot housing and operationally connected to the motor;

a power jack extending through the robot housing and connected in electric communication with the battery;

a pan assembly operationally connected to the robot housing and further comprising:

a generally flat elongated pan member;

a first articulated armature connected to the robot housing and to the generally flat elongated pan member;

a first servo operationally connected to the first articulated armature and to the battery;

a roller;

a second articulated armature connected to the robot housing and to the roller;

a second servo operationally connected to the second articulated armature and to the battery;

a second microprocessor operationally connected to the battery, to the first servo, to the second servo, and to the motor;

a forward sensor assembly mounted to the housing and operationally connected to the second microprocessor;

a guidance unit operationally connected to the second microprocessor and to at least one respective axel;

a GPS transponder operationally connected to the robot housing, and to the second microprocessor; and a robot transceiver operationally connected to the second microprocessor;

wherein the microprocessor receives images from the forward sensor assembly and directs the guidance unit to steer the mobile robot to feces deposits;

wherein the second microprocessor sends signals to deploy the pan assembly to pick up feces deposits for transport back to the garage housing to be deposited into the bin.

2. The automated animal feces collection and storage system of claim 1 wherein the robot automatically collects feces from a predetermined area.

3. The automated animal feces collection and storage system of claim 1 wherein the second microprocessor receives manual control signals for guiding the mobile robot.

4. The automated animal feces collection and storage system of claim 1 wherein the first microprocessor sends a signal when the weight scale detects a bin weight exceeding a predetermined value.

5. The automated animal feces collection and storage system of claim 1 wherein the forward sensor is a camera.

6. An automated animal feces collection and storage assembly, comprising:

a stationary portion; and a mobile robot portion;

wherein the stationary portion further comprises:

a raised platform;

a ramp extending from the raised platform;

an aperture formed through the raised platform;

a bin disposed below the aperture;

a charge port operationally connected to the raised platform;

a power source operationally connected to the charge port;

a first microprocessor operationally connected to the raised platform and operationally connected to the power source;

a first transceiver operationally connected to the first microprocessor and to the power source; and a weight scale operationally connected to the bin, the power source, and the first microprocessor;

wherein the mobile robot further comprises:

a robot housing;

spaced front and real axels operationally connected to the robot housing;

spaced wheels operationally connected to each respective axel;

a motor disposed within the robot housing and operationally connected to the at least one respective axel;

a battery disposed within the robot housing and operationally connected to the motor;

a power jack extending through the robot housing and connected in electric communication with the battery;

a pan assembly operationally connected to the robot housing and further comprising:

a generally flat elongated pan member;

a first articulated armature connected to the robot housing and to the generally flat elongated pan member;

a first servo operationally connected to the first articulated armature and to the battery;

a roller;

a second articulated armature connected to the robot housing and to the roller;

a second servo operationally connected to the second articulated armature and to the battery;

a second microprocessor operationally connected to the battery, to the first servo, to the second servo, and to the motor;

a forward sensor assembly mounted to the housing and operationally connected to the second microprocessor;

a guidance unit operationally connected to the second microprocessor and to at least one respective axel;

a robot transceiver operationally connected to the second microprocessor;

wherein the microprocessor receives images from the forward sensor assembly and directs the guidance unit to steer the mobile robot to feces deposits;

wherein the second microprocessor sends signals to deploy the pan assembly to pick up feces deposits for transport back to the garage housing to be deposited into the bin.

* * * * *